US006777653B2

(12) United States Patent
Burkhart

(10) Patent No.: US 6,777,653 B2
(45) Date of Patent: Aug. 17, 2004

(54) IGNITER CONTROLLER

(75) Inventor: Richard Burkhart, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/255,424

(22) Filed: Sep. 26, 2002

(65) Prior Publication Data

US 2004/0060924 A1 Apr. 1, 2004

(51) Int. Cl.[7] ..... F23Q 7/00; H05B 1/02
(52) U.S. Cl. ..... 219/497; 219/263
(58) Field of Search ..... 219/497, 263, 219/260, 270; 431/28, 66, 258; 361/264–266

(56) References Cited

U.S. PATENT DOCUMENTS

| | | | | | |
|---|---|---|---|---|---|
| 3,739,186 | A | | 6/1973 | Gokey et al. | 307/23 |
| 4,260,985 | A | * | 4/1981 | Hayden | 340/635 |
| 4,402,663 | A | | 9/1983 | Romanelli et al. | 431/66 |
| 4,474,548 | A | | 10/1984 | Miyanaka et al. | 431/1 |
| 4,809,128 | A | | 2/1989 | Geary | 361/264 |
| 4,925,386 | A | * | 5/1990 | Donnelly et al. | 219/260 |
| 4,935,606 | A | | 6/1990 | Geary | 219/501 |
| 4,978,292 | A | | 12/1990 | Donnelly et al. | 431/75 |
| 5,003,161 | A | | 3/1991 | Geary | 219/501 |
| 5,122,968 | A | * | 6/1992 | Bauer et al. | 364/483 |
| 5,249,096 | A | | 9/1993 | Williams | 361/264 |
| 5,416,300 | A | | 5/1995 | Hickl et al. | 219/262 |
| 5,475,202 | A | * | 12/1995 | Schallis | 219/497 |
| 5,567,144 | A | | 10/1996 | McCoy | 431/79 |
| 5,725,368 | A | * | 3/1998 | Arensmeier | 431/66 |
| 5,789,723 | A | | 8/1998 | Hirst | 219/501 |
| 5,865,612 | A | * | 2/1999 | Hill et al. | 431/67 |
| 5,899,684 | A | | 5/1999 | McCoy et al. | 431/779 |
| 5,951,276 | A | | 9/1999 | Jaeschke et al. | 431/66 |
| 6,359,266 | B2 | * | 3/2002 | Little et al. | 219/501 |
| 6,521,869 | B1 | * | 2/2003 | Donnelly et al. | 219/263 |
| 2003/0164368 | A1 | * | 9/2003 | Chodacki et al. | 219/497 |

FOREIGN PATENT DOCUMENTS

CH 686013 * 11/1995

OTHER PUBLICATIONS

Hirst et al., "Low–Flicker Universal Power Converter for Filament–Based Heating Process", IEEE Transactions of Industry Applications; vol. 34, No. 6, Nov./Dec. 1998.

* cited by examiner

*Primary Examiner*—John A. Jeffery
(74) *Attorney, Agent, or Firm*—Harness Dickey & Pierce, P.L.C.

(57) ABSTRACT

An igniter controller for controlling an igniter, such as a silicon nitride hot surface igniter, provides high frequency switching of full wave rectified alternating current across the igniter using a switching transistor in combination with a filter and a full wave rectifier bridge. The igniter controller may be tuned based upon the particular igniter in connection with which control is provided to allow for precise control of switching of power to the igniter. The full wave rectifier bridge is provided in connection with the switching transistor to provide high frequency switching of AC power across the igniter.

32 Claims, 3 Drawing Sheets

IGNITER CONTROLLER

FIELD OF THE INVENTION

This invention relates generally to controls for gas appliances, and more particularly to a controller for controlling power to an igniter for a gas furnace.

BACKGROUND OF THE INVENTION

Most gas furnaces manufactured today include some type of electronic ignition system and, in particular, hot surface igniters that produce high temperatures (e.g., 2000+ degrees Fahrenheit) for burner ignition within the furnace. The hot surface igniter, when activated, ignites gas flow of a main burner of the furnace without the need for a pilot light. These electronic ignition systems reduce gas consumption and increase the efficiency of the furnace, thereby increasing the efficiency of the HVAC system to which they are connected. Further, gas ignition is provided without the need for a continuously burning pilot light or flame, thereby reducing the possibility of a dangerous condition occurring (e.g., ignition of lint or other combustibles near the pilot flame) and providing an easier means for igniting the furnace (e.g., no need to use a match to reignite the pilot flame).

Several different types of hot surface igniters exist for use with gas furnaces. The most common types include silicon nitride igniters, silicon carbide igniters, and mini silicon carbide igniters. Further, hot surface igniters may be constructed of different materials including aluminum nitride, silicon nitride, silicon carbide, boron carbide, tungsten disilicide, tungsten carbide, and mixtures thereof. More and more, silicon nitride igniters are used and are replacing other types of hot surfaces igniters because of their durability and consistent performance, thereby improving efficiency and providing longer useful life. Further, these silicon nitride igniters are capable of operation under many different and varied conditions, including, for example, when exposed to water, condensation, bleach and other contaminants.

However, due to the operating characteristics of the materials used in these igniters (and in particular silicon nitride), as well as the extreme variations in temperature experienced by these igniters, proper control of the power supply to the silicon nitride igniter is required in order to prevent a direct current component across the igniter. This is needed in order to minimize material migration of igniter elements, which migration may result from the igniter brazing material (e.g., silver) migrating between the positive igniter electrode and negative igniter electrode, thereby causing a short across the electrodes and failure of the igniter. Minimizing material migration by controlling the power supply (e.g., controlling power level and switching of the power supply) to the igniter extends the igniter life.

Thus, it is desirable to regulate power to silicon nitride hot surface igniters to maintain proper operating conditions, such as a proper power level to maintain a proper temperature to provide gas ignition. As recognized by the inventor hereof, a control for controlling power to a silicon nitride hot surface igniter should respond to changes in line voltage to provide a constant effective voltage across the igniter. Known control devices and methods for use in connection with silicon nitride igniters, and in general resistive heating elements, are typically integral half-cycle controls (IHC), proportional controls or phase controls. These devices and methods usually switch at or below the main power frequency and typically use a triac as a switching element. These devices and methods usually provide poor power factor, flicker and high harmonic currents, which may result in interference (e.g., EMI). Further, IHCs produce subharmonics. Therefore, these devices and methods must be filtered to reduce harmonics on the power line. New regulations for flicker and current harmonics will likely soon require improvement of the power quality of control devices for controlling power to these types of igniters.

SUMMARY OF THE INVENTION

The present invention provides an igniter controller for controlling power to a hot surface igniter that responds to changes in line voltage to the igniter to provide a constant and effective voltage across the igniter. The igniter controller uses asynchronous pulse width modulation that switches at a frequency above the audible range, thereby reducing potential interference (e.g., EMI). More particularly, the igniter controller uses a single switching transistor in series with the igniter that is pulse width modulated and that provides current flow in both directions to the igniter using a full wave rectifier bridge (i.e., switching of alternating current (AC)).

Specifically, in one embodiment of the present invention an igniter controller includes means for determining the voltage across an igniter, means for comparing the voltage across the igniter to a reference voltage, and means for selectively changing an alternating current (AC) for powering the igniter and based upon the comparison. The means for selectively changing may include means for switching the AC across the igniter. The igniter controller may further include means for setting or varying the reference voltage.

In another embodiment of the present invention an igniter controller for use with a hot surface igniter includes a filter circuit for filtering an alternating current (AC) power source, a switching transistor for switching the filtered AC power across the hot surface igniter, a full wave rectifier bridge for rectifying the AC power source to provide rectified AC power for switching the switching transistor, and a pulse width modulation and error control circuit for comparing a reference voltage to the voltage across the hot surface igniter to control the switching transistor for switching the filtered AC power across the hot surface igniter. The igniter controller further may include a variable resistor for setting the reference voltage.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 4(*b*) is a schematic diagram showing connection of a silicon nitride igniter module having an igniter controller of the present invention to an ignition module for use in a gas furnace.

DETAILED DESCRIPTION OF THE PREFERRED EMBODIMENTS

The following description of the preferred embodiments is merely exemplary in nature and is in no way intended to limit the invention, its application, or uses. Although a controller of the present invention is described in connection with specific component parts for use with a particular ignition system and/or hot surface igniter, it is not so limited, and additional component parts may be implemented with different ignition systems in connection with other types of hot surface igniters.

Figure 1:
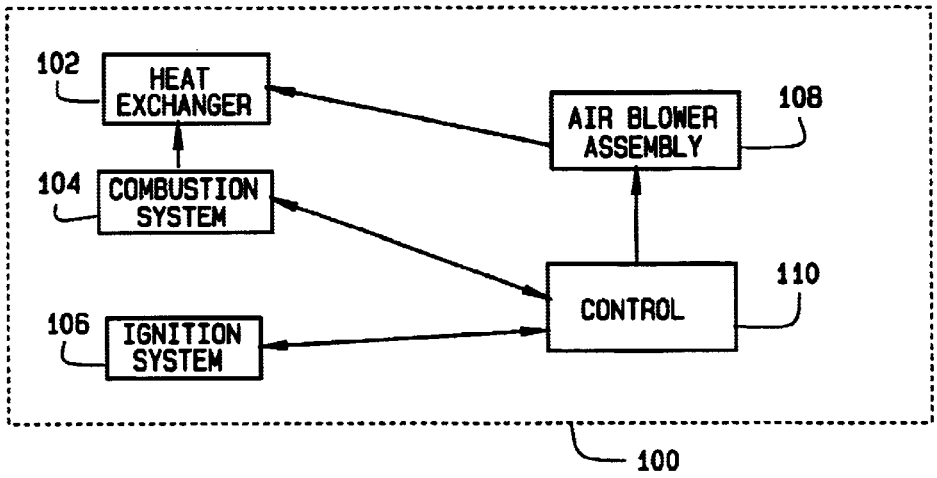
FIG. 1 is a block diagram showing the component parts of a typical furnace in an HVAC system in which an igniter controller constructed according to the principles of the present invention may be implemented.

Before describing an igniter controller constructed according to the principles of the present invention for use with a hot surface igniter, a typical gas furnace system in connection with which the igniter controller may be implemented will be described. As shown in FIG. 1, a typical gas furnace system 100 includes a heat exchanger 102, a combustion system 104, an ignition system 106, an air blower assembly 108 and an operator control 110 (e.g., thermostat). The operator control 110, which is programmed or configured by a user, operates the various aspects of an HVAC system, which typically includes the furnace system 100. This operation includes, for example, activation of the heating of the gas furnace, which requires the opening of a gas valve and triggering of an igniter (e.g., a silicon nitride hot surface igniter). Further, a furnace control may be used in conjunction with the operator control 110 to control operation of the furnace.

Figure 2:
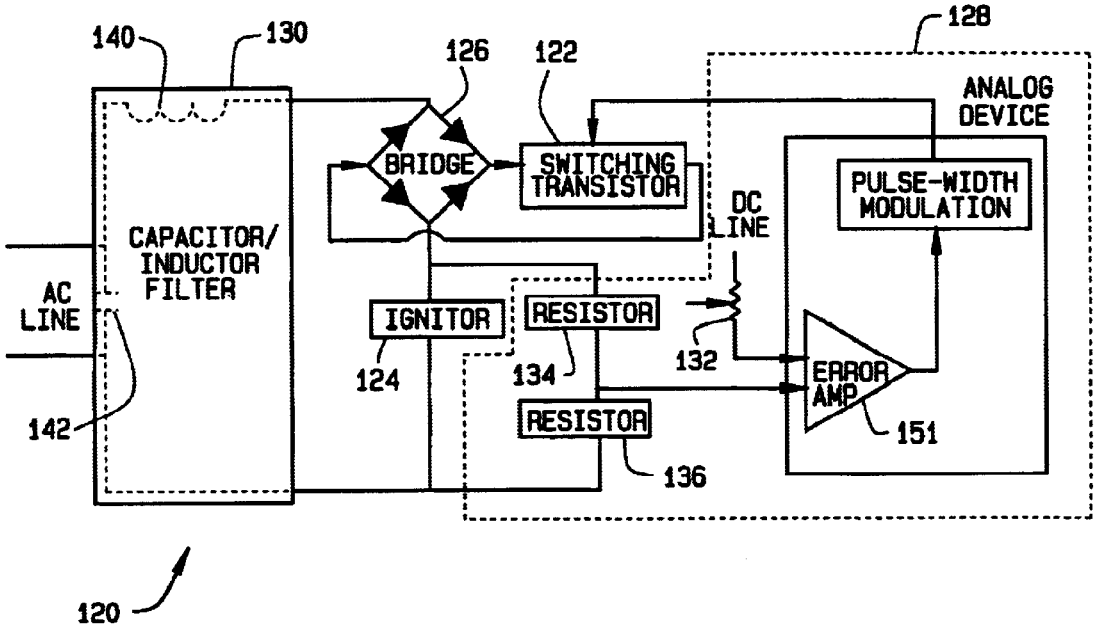
FIG. 2 is a block diagram of an igniter controller constructed according to the principles of the present invention for use with a hot surface igniter.
Figure 3:
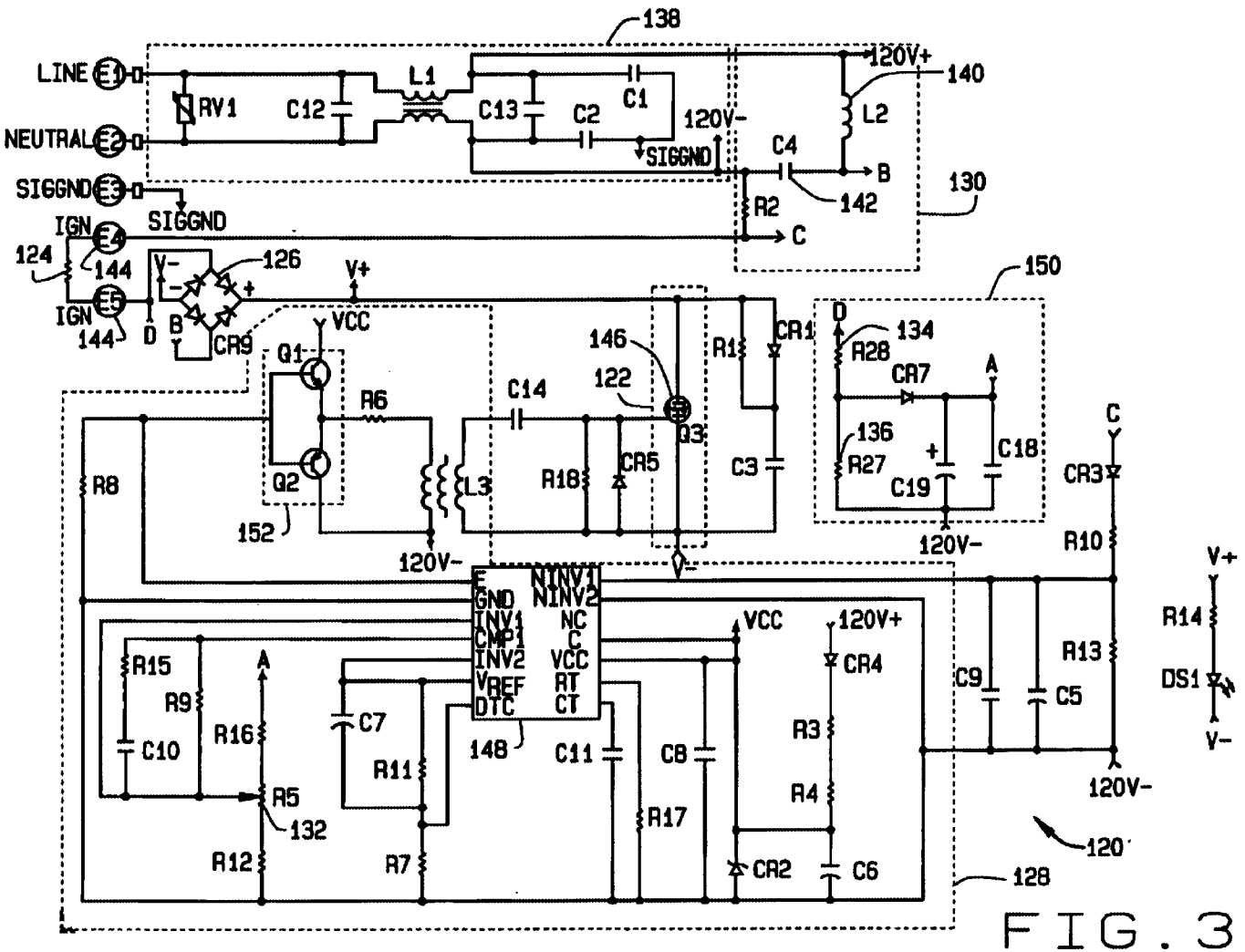
FIG. 3 is a schematic diagram of an igniter controller of the present invention for use with a hot surface igniter.

Having described an exemplary gas furnace system 100 in connection with which an igniter controller of the present invention may be implemented, an igniter controller 120 constructed according to the principles of the present invention is shown in FIGS. 2 and 3. The igniter controller 120 may be provided as a separate unit or may be provided, for example, as part of a furnace control. Generally, the igniter controller 120 provides asynchronous power control of a hot surface igniter (e.g., silicon carbide or silicon nitride hot surface igniter) with unity power factor and low harmonics. In particular, the igniter controller 120 responds to changes in line voltage to provide a constant effective voltage across the igniter, which is provided by comparison to an adjustable reference voltage. This reference voltage may be tuned or adjusted based upon the properties of the particular silicon nitride hot surface igniter being controlled (e.g., resistance of the igniter). Using an igniter controller 120 of the present invention, a lower power supply (e.g., about 80 volts to about 90 volts), which is required for operation of a silicon nitride hot surface igniter, is provided without the use of a separate microcontroller or microprocessor.

In general, and as shown in FIG. 2, the igniter controller 120 includes a switching transistor 122 in series with an igniter 124 that is pulse width modulated using a pulse width modulation and error amplifier circuit 128 to provide operation at a high frequency above the audible range (e.g., approximately 100 kHz). The switching transistor 122 is provided within a full wave rectifier bridge 126 to provide a full wave switch. Thus, the switching transistor 122 and the full wave rectified bridge 126 cooperate to power the igniter 124 using switching provided by a full wave rectified signal. AC power is thereby provided to the igniter 124, which allows current flow in both directions through the igniter 124 to reduce migration of materials in the igniter resist pattern. A filter 130 includes a capacitor 142 in parallel with a main AC supply and an inductor 140 in series with the main AC supply, for storing power to smooth the power supply driving the igniter 124 (e.g., reduce spikes and ripple effects).

Further, the igniter controller 120 includes a variable resistor 132 (e.g., potentiometer) for setting a resistance value and thereby setting a reference voltage to tune the igniter controller 120 depending upon the particular characteristics of the igniter 124 (e.g., operating characteristics). Additionally, a first resistor 134 and a second resistor 136 configured as a voltage divider as part of an RC filter 150 (shown in FIG. 4) are provided to determine (i.e., measure) the voltage across the igniter 124. The output of the voltage divider is provided to an error amplifier 151 of the pulse width modulation and error amplifier circuit 128.

Figure 4A:
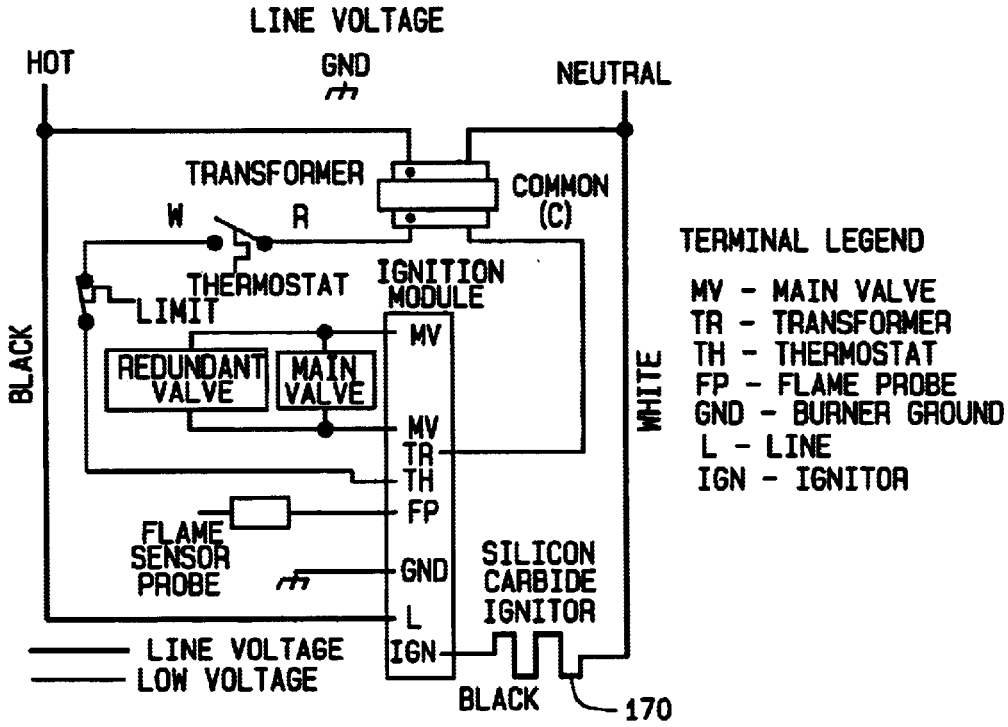
FIG. 4(*a*) is a schematic diagram showing connection of a silicon carbide igniter to an ignition module for use in a gas furnace.
Figure 4B:
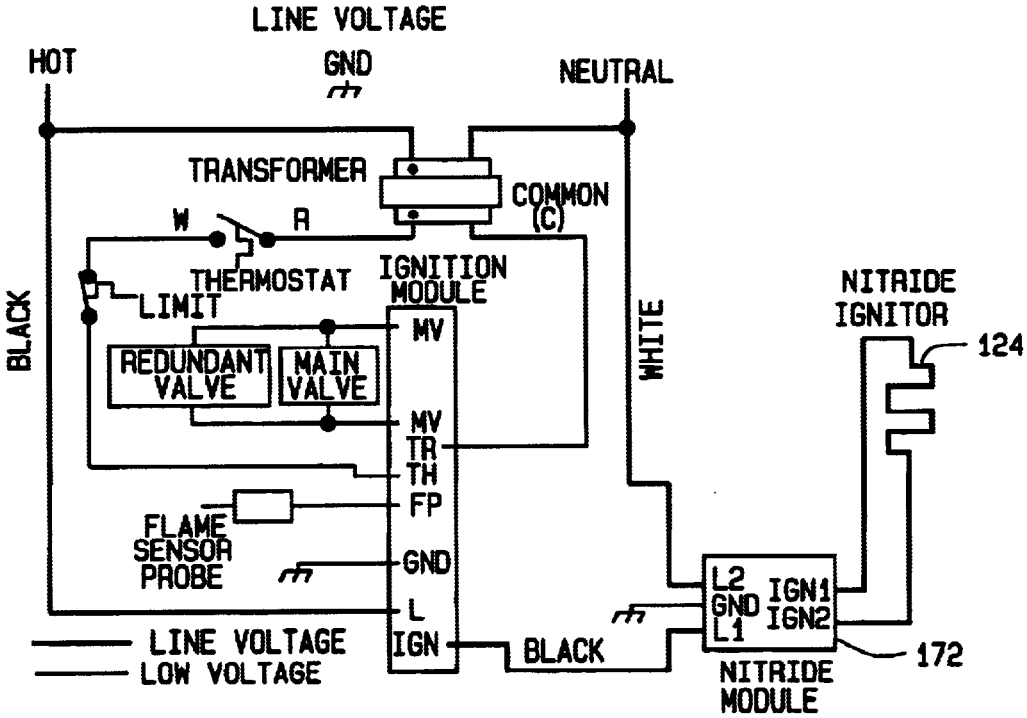

More particularly, and with reference now to FIG. 4, the igniter controller 120 includes a signal filter network 138 for filtering the incoming line voltage (e.g., filtered to reduce interference such as EMI and RFI). The filter 130 is connected to the signal filter 138 to further provide stored power for driving the igniter 124 and reducing variances in the AC supply. In one embodiment, the inductor 140 is rated at 100 microHenry ($\mu$H) at two amps and available from Beckman Industrial Technology and the capacitor 142 is rated at 3.3 microFarads ($\mu$F) at 250 volts and available from Illinois Capacitor. The igniter 124 is connected to igniter terminals 144 of the igniter controller 120, which provides full wave rectified AC with the full wave rectifier bridge 126. The switching transistor 122 is in series connection with the full wave rectifier bridge 126 and provides pulse width modulation as controlled by the pulse width modulation and error amplifier circuit 128. In this embodiment, the switching transistor 122 is a field effect transistor (FET) 146, Model Number STP11BN40 available from ST Microelectronics.

The pulse width modulation and error amplifier circuit 128 includes a driver component 148 for receiving a reference voltage as set by the variable resistor 132 and comparing the received reference voltage to the voltage across the igniter 124 as determined by the RC filter 150. Essentially, the driver component 148 provides an error signal for use in correcting the instantaneous voltage to the igniter 124 (i.e., for driving the FET 146) based upon the difference between the reference voltage, as tuned by the variable resistor 132, and the measure voltage across the igniter 124. In this embodiment, the driver component 148 is a MC33060A pulse width modulating chip with on-chip error amplifier, available from On Semiconductor. The reference voltage is supplied to the inverted pin of the on-chip error amplifier, and the measured voltage across the igniter is supplied to the non-inverted pin of the on-chip error amplifier. Further, the pulse width modulation and error amplifier circuit 128 includes a totem pole transistor component 152 to drive the output at both high and low levels.

In this embodiment, the variable resistor 132 is a 5000 (5K) Ohm variable potentiometer Model No. 25PR5K, available from Beckman Industrial Technology. Further, resistors 134 and 136 are 30K and 1K Ohm rated resistors, respectively.

In operation, the igniter controller 120 provides for switching AC across the igniter 124 at a voltage preferably between about 80 and about 90 volts as tuned by the variable resistor 132 and based upon the properties of the igniter 124 (e.g., resistor properties) being controlled. In particular, the driver component 148 receives a voltage measurement from across the igniter 124 as provided by the RC filter 150 (i.e., measured by the voltage divider including resistors 134 and 136) and compares this value to a predetermined voltage value, which is a desired voltage value, as set by the variable resistor 132. The predetermined voltage value is set based upon the properties and operating characteristics of the igniter 124 being controlled. Based upon the comparison, an error value (e.g., difference between measured and desired value) is used to control the FET 146 to drive the igniter 124 using a full wave rectified signal provided by the full wave rectifier bridge 126. Essentially, the driver component 148 changes the duty cycle at which it drives the FET 146 based upon the difference between the measured voltage from the RC filter 150 and the reference voltage as set by the variable resistor 132.

The full wave rectifier bridge 126 limits (e.g., chops at a specific voltage level) the AC supply on both the positive and negative line cycles, and in combination with the switching transistor 126 provides alternating current across the igniter 124. Therefore, using the igniter controller 120 of the present invention, higher frequency switching of voltage across an igniter 124 is provided (e.g., switching throughout the line cycle and not just at the zero crossing points) at a voltage level, for example, between about 80 volts and about 90 volts to power the igniter (e.g., a silicon nitride hot surface igniter). It should be noted that depending upon the type of igniter being controlled, the various component parts of the igniter controller 120 may be modified. For example, the variable resistor 132 may be modified or replaced to provide a reference voltage to drive the igniter between a different voltage range.

Using the igniter controller 120 for switching power across the igniter 126, no flicker effects result and a near unity power factor is provided. Further, by selecting appropriate values for the component parts, the control characteristics of the igniter controller 120 may be modified. For example, depending upon the values of the inductor 140 and capacitor 142, the filter 130 may provide an igniter controller 120 that is almost purely resistive to the AC main supply, thus yielding a near unity power factor. Further, the filter 130 is configured to eliminate current harmonics of the main current frequency. Also, power output is proportional to the duty cycle ratio.

Further, the igniter controller 120 may be provided (e.g., installed) as part of a new furnace installation and/or may be provided for replacement, such as for a retrofit application as part of a retrofit kit for replacement of an existing igniter system. For example, as shown in FIGS. 4(*a*) and 4(*b*), an existing silicon carbide igniter 170 may be replaced with a silicon nitride igniter module 172 having the igniter controller 120 of the present invention and provided in connection with a silicon nitride igniter 124. The igniter controller 120 as part of the silicon nitride igniter module 172 is tuned based upon the characteristics of the silicon nitride igniter 124 provided in connection therewith (e.g., as part of a retrofit kit). Specifically, the variable resistor 132 is adjusted based upon the characteristics of the silicon nitride igniter 124 to be controlled. As shown in FIGS. 4(*a*) and 4(*b*), no additional component parts are required and no separate controller (e.g., microcontroller or microprocessor) is to control the igniter 124 in either a new installation or retrofit application.

Therefore, using an igniter controller 120 of the present invention, high frequency switching of an igniter 124 is provided that reduces flicker effect and provides unit power factor at a power output that is proportional to the duty cycle ratio. The igniter controller 120 may be tuned based upon the characteristics of the igniter 124 being controlled and may be used in initial installation and/or retrofit applications. By switching AC across the igniter 124, currents flow in both directions through the igniter 124 to reduce migration of materials in the igniter 124.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An igniter controller comprising:

means for determining a voltage across an igniter;

means for comparing the determined voltage across the igniter to a reference voltage; and means for switching off and on a current alternating across the igniter, the switching performed during a half-cycle of the current based upon the comparison between the determined voltage and the reference voltage.

2. The igniter controller according to claim 1, the means for switching comprising means for providing pulse width modulation.

3. The igniter controller according to claim 2, the means for providing pulse width modulation comprising means for determining an error value based upon the comparison between the determined voltage and the reference voltage.

4. The igniter controller according to claim 1 further comprising means for filtering the current alternating across the igniter.

5. The igniter controller according to claim 1 further comprising means for setting the reference voltage.

6. The igniter controller according to claim 5 wherein the means for setting the reference voltage comprises means for varying the reference voltage.

7. The igniter controller according to claim 1 further comprising means for providing full wave rectification of current to the means for switching a current alternating across the igniter.

8. The igniter controller according to claim 1 wherein the igniter is a silicon nitride igniter.

9. The igniter controller according to claim 8 wherein the reference voltage is between about 80 volts and about 90 volts.

10. An igniter controller for use with a hot surface igniter comprising:

a filter circuit for filtering power from an alternating current (AC) power source;

a switching transistor for switching off and on the filtered AC power alternating across the hot surface igniter;

a full wave rectifier bridge for rectifying the AC power to provide rectified AC power for switching off and on by the switching transistor during a rectification half-cycle of the rectifier bridge; and a pulse width modulation and error control circuit for comparing a reference voltage to a voltage across the hot surface igniter to control the switching transistor.

11. The igniter controller according to claim 10 further comprising a variable resistor for setting the reference voltage.

12. The igniter controller according to claim 10 further comprising an RC filter circuit for measuring the voltage across the hot surface igniter.

13. The igniter controller according to claim 12 wherein the RC filter circuit comprises a voltage divider.

14. The igniter controller according to claim 10 wherein the hot surface igniter is a silicon nitride igniter.

15. The igniter controller according to claim 14 wherein the reference voltage is set between about 80 volts and about 90 volts.

16. The igniter controller according to claim 10 wherein the switching transistor is a field effect transistor.

17. A method of controlling power supplied to an igniter comprising:

receiving a reference voltage;

determining a voltage across the igniter; and during half-cycles of a current alternating across the igniter, switching the current off and on based upon a comparison between the received reference voltage and the determined voltage across the igniter.

18. The method according to claim 17 further comprising setting the reference voltage.

19. The method according to claim 17 wherein an igniter retrofit kit comprises the igniter and an igniter controller for providing the steps of receiving, determining and switching.

20. The igniter controller of claim 10 wherein the pulse width modulation and error control circuit is an analog circuit.

21. A method of controlling an igniter comprising:

comparing a voltage alternating across the igniter to a reference;

producing a modulating signal based upon the comparing; and chopping the voltage alternating across the igniter in response to the modulating signal;

the comparing and producing performed by an analog circuit;

the chopping performed during a half-cycle of the voltage.

22. The method of claim 21, the chopping performed at a frequency above the audible range.

23. The method of claim 22 wherein the frequency comprises 100 kilohertz.

24. The method of claim 21, the chopping performed using a single transistor driven by the analog circuit.

25. The method of claim 21 further comprising adjusting a variable resistor to set the reference.

26. The method of claim 21 wherein chopping the voltage alternating across the igniter comprises:

fully rectifying the voltage using a rectifier bridge; and switching the rectified voltage off and on using a single transistor to which the rectified voltage is input.

27. The method of claim 21 further comprising filtering the voltage to obtain essentially a unity power factor across the igniter.

28. An igniter controller comprising:

an analog circuit that compares a voltage alternating across the igniter to a reference and produces a modulating signal based on the comparing; and a switch that chops the voltage alternating across the igniter in accordance with the modulating signal at a frequency above the audible range.

29. The igniter controller of claim 28 further comprising a full wave rectifier that rectifies the voltage, the switch comprising a single transistor to which the rectified voltage is input.

30. The igniter controller of claim 28 wherein the switch chops the voltage asynchronously relative to a line cycle of the voltage.

31. The igniter controller of claim 28 further comprising a filter configured to produce essentially a unity power factor across the igniter.

32. The igniter controller of claim 28 configured to be installed with the igniter across a line voltage of another igniter to replace the other igniter.

* * * * *